US005573018A

United States Patent [19]

Johnson

[11] Patent Number: 5,573,018

[45] Date of Patent: Nov. 12, 1996

[54] HAIR BARRETTE WITH REPLACEABLE ORNAMENTS

[76] Inventor: Destrina D. Johnson, 630-½ S. Broadway Apt. #1, Menomonie, Wis. 54751

[21] Appl. No.: 510,746

[22] Filed: Aug. 3, 1995

[51] Int. Cl.[6] ..... A45D 8/12

[52] U.S. Cl. ..... 132/275; 132/273; 132/276; 132/278

[58] Field of Search ..... 132/275, 276, 132/278, 273; 411/338, 339, 508, 509, 913

[56] References Cited

U.S. PATENT DOCUMENTS

| | | | |
|---|---|---|---|
| 401,649 | 4/1889 | Hackett | 132/275 |
| 887,149 | 5/1908 | Tainow . | |
| 921,702 | 5/1909 | Howe . | |
| 1,552,147 | 9/1925 | Hall | 411/338 |
| 2,169,596 | 8/1939 | Solomon | 132/275 |
| 2,316,225 | 4/1943 | Hoffman et al. | 63/29.1 |
| 3,192,932 | 7/1965 | Hart | 132/275 |
| 3,441,032 | 4/1969 | Barrett | 132/275 |
| 3,633,592 | 1/1972 | Buglro et al. | 132/276 |
| 3,921,496 | 11/1975 | Helderman | 411/339 |
| 5,000,637 | 3/1991 | Adams | 411/339 |
| 5,355,698 | 10/1994 | Edmark | 163/29.1 |

FOREIGN PATENT DOCUMENTS

| | | | |
|---|---|---|---|
| 2174001 | 10/1986 | United Kingdom | 132/275 |

*Primary Examiner*—Gene Mancene
*Assistant Examiner*—Pedro Philogene
*Attorney, Agent, or Firm*—Dwight N. Holmbo

[57] ABSTRACT

An ornamental hair barrette provides a mechanism allowing for rapid replacement, removal or addition of alternate ornamental appendages without requiring the wearer to remove the barrette from the wearer's hair each time the ornamental appendages are replaced, removed or supplemented. The mechanism includes ribs and recesses for interlocking a stem to a shaft having at least one slot extending substantially lengthwise along the stem or the shaft which allows the interlocking to take place via spring-like expansion and retraction of the stem or shaft respectively.

4 Claims, 5 Drawing Sheets

HAIR BARRETTE WITH REPLACEABLE ORNAMENTS

BACKGROUND OF THE INVENTION

1. Field of the Invention

The present invention relates to a barrette and, more particularly, a barrette having ornaments which are easily and quickly removed and replaced.

2. Description of the Prior Art

Hair barrettes or hair clamping devices have been utilized for a long period of time as exemplified by U.S. Pat. No. 921,702, issued to Howe on May 18, 1909. As shown by Howe, barrettes typically include a curved metal strip having a wire clamp or pin that closes about the user's hair to maintain the hair in place.

It is also common custom for people to adorn themselves with ornamental structures such as ribbons or broaches. In U.S. Pat. No. 887,149, issued to Tarnow on May 12, 1908, there is disclosed a fastening device for securing bows in a person's hair.

Conventional barrettes usually comprise an arcuate clip which carries an assembly of pivotal bars and locking elements for the actual clamping of a tress of hair, and an arcuate, usually broader, plastic holder or metal bar to which the clip is attached. Together, the plastic holder or metal bar so coupled to an arcuate clip may be referred to as a hair clamp. The outer side of the holder can be decorated or adorned with various ornamental appendages such as jewelry, lace and the like. However, one of the most limiting features of early barrettes such as Tarnow's is that, if a person wearing a barrette desired a change of the barrett's appearance, she would need to remove the entire barrette from her hair and replace it with another barrette having different ornamental features.

Barrettes further evolved with replaceable ornamental features through the teachings such as U.S. Pat. No. 3,192,932, issued to Hart on Jul. 6, 1965, and U.K Patent No. 2,174,001, issued to Pabari on Apr. 19, 1985. Through these inventions, features such as ribbons, flowers, bows and the like can be removed and inserted into the barrette, thereby providing an economical means of enjoying a variety of styles and ornaments together with one basic barrette.

The designs of Hart and Pabari, however, have their limitations. Hart discloses a barrette with ornamental member, male and female snap members, and a plurality of tabs and notches which are designed to secure the ornamental member, through the snap members, to the hair clamp. Hart's teaching requires several elements, including arrays of tabs and notches, elements which contribute to the cost of manufacturing. The connecting means of Pabari's teaching requires the use of female and male spigots which must be removed and reset each time the ornamental member is replaced. One of the Pabari spigots must be placed underneath the body member of the barrette in order to receive its mate spigot (male or female) which, thereby, secures the ornamental piece from above. This limitation requires the Pabari barrette to be removed from the wearer's hair each time the ornamental member is to be replaced. Yet another limitation of the Hart and Pabari designs is that wearers may desire to wear several ornamental members simultaneously, mixing and matching a number of ornaments together, thereby achieving a multiplicity of styles and appearances at an economical price, yet this objective is not achievable in the design of Hart and not easily achievable through the teaching of Pabari Furthermore, another limitation of the Hart and Pabari designs is that the wearer may desire the body of the barrette to be concealed completely by its ornaments while the barrette is worn, a feature not completely accomplished by the designs of Hart and Pabari due to the complexities of their coupling means. Hart discloses a coupling means which protrudes outward from the body of the barrette and a decorative piece which, when coupled to the body, is further extended from the body of the barrette by the length of the coupling means.

Other art such as that disclosed in U.S. Pat. No. 5,355,698, issued to Edmark on Oct. 18, 1994, teaches the use of interchangeable ornaments for non-barrette hair pieces. Edmark discloses the combination of a setting which includes a frame and a base, at least one interchangeable, decorative piece, and a coupling means for coupling the decorative piece to the setting. Whereas Edmark discloses designs for economical, replaceable hair ornaments, this teaching falls short of combining these features together with the highly desirable hair grooming attributes of a barrette. Also, the frame element of Edmark confines the sizes and shapes of replaceable decorative pieces to the sizes and shapes of the frame.

While a barrette is an inexpensive item, the creation of a barrette having a flexible design for an economical price is a challenge which manufacturers face regularly. A disadvantage of known barrette designs is that to acquire a broad variety of color coordinates, including the causal as well as formal, together with a variety of shapes and sizes, so that a person can enhance their wardrobe at an economical price is typically achieved by purchasing numerous barrettes, each having a single color and ornamental design. While a single barrette may be an inexpensive item, purchasing several barrettes can be costly, particularly for those on lower clothing budgets. These limitations are problematic both for manufacturers and the barrette wearing public, yet they are all overcome by the innovations disclosed herein.

SUMMARY OF THE INVENTION

The present invention overcomes the disadvantages of known ornamental hair barrettes by providing a barrette having a mechanism allowing for replacement, removal or addition of alternate ornamental appendages, amenable to rapid and economic assembly while providing ample securement of the ornamental appendages.

Another feature of the present invention is the provision of ornamental barrette which offers the consumer a broad variety of ornamental designs and color coordinates, casual as well as formal, at an economical price.

Another feature of the present invention is the unique design of the coupling means which, together with other inventive features, makes it possible for the barrette to receive either a single ornamental appendage, or several ornamental appendages simultaneously. This feature enables the wearer to mix and match her complement of ornaments in a multiplicity of combinations, thereby providing the wearer having a relatively few number of ornaments a greater range of looks and appearances from which the wearer can choose.

Yet another feature makes it possible for one or more ornamental appendages, by their size, to completely conceal the body of the hair clamp when the barrette is worn.

Furthermore, another feature makes it possible for one or more ornamental appendages to be recessed, through a stem which is coupled to the hair clamp, whereby the ornamental appendages are not extended from the hair clamp as taught by the prior art but capable of being placed adjacent to the hair clamp, a feature which further conceals the hair clamp and thereby results in a more attractive appearance.

The present inventive barrette incorporates a stem assembly permanently attached to a hair clamp. An ornamental knob adapted to engage stem assembly shaft through an innovative coupling means can be used alone as an ornament or in conjunction with one or more ornamental appendages such as lace, bows and the like.

BRIEF DESCRIPTION OF THE DRAWINGS

Other objects of the present invention and many of the attendant advantages of the present invention will be readily accepted as the same becomes better understood by reference to the detailed description when considered in connection with the accompanied drawings in which like reference numerals designate like parts throughout the figures thereof and wherein.

PREFERRED EMBODIMENT

Figure 1:
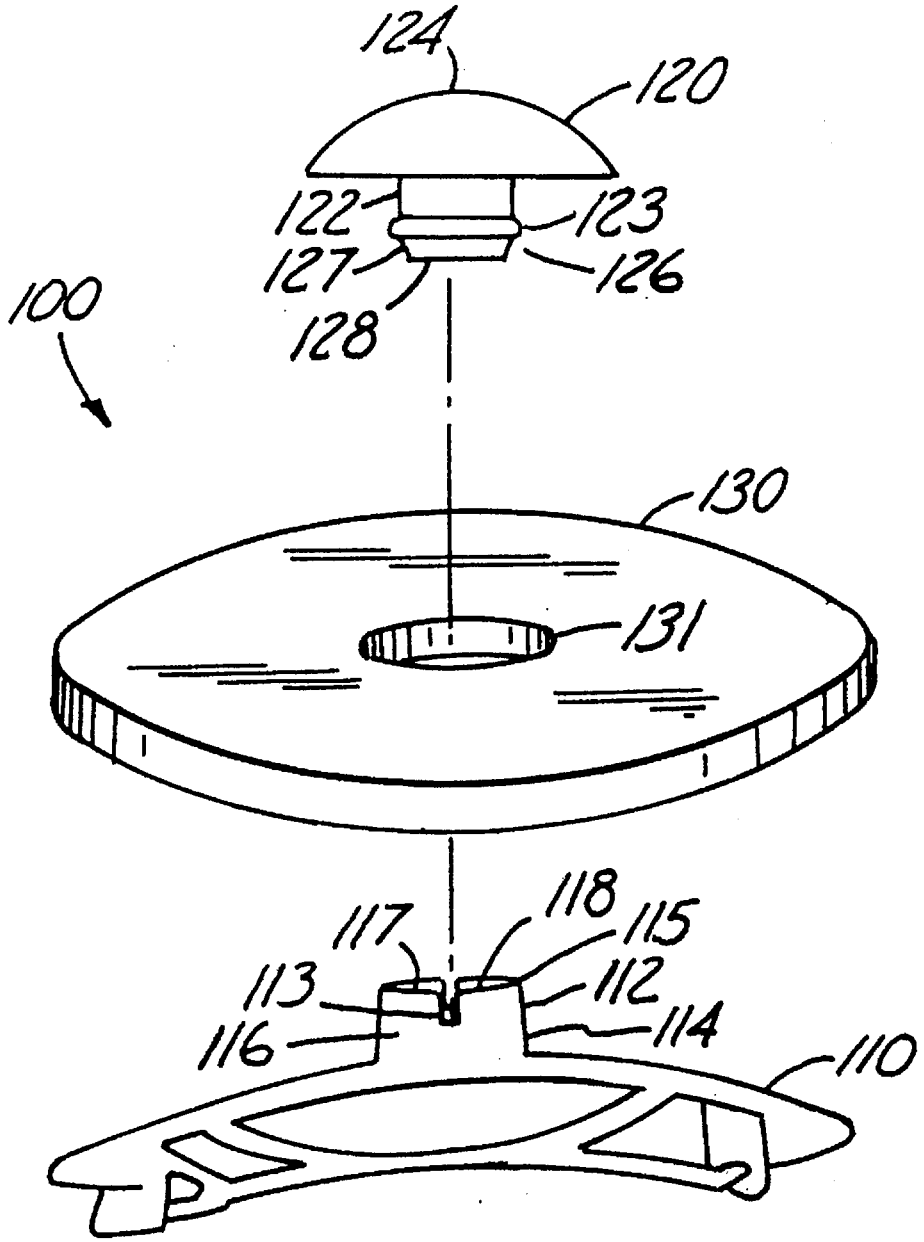
FIG. 1 illustrates one preferred embodiment of the present invention in exploded view, showing a hair clamp coupled to a stem assembly, a replacable ornamental piece, and an ornamental button assembly.
Figure 2:
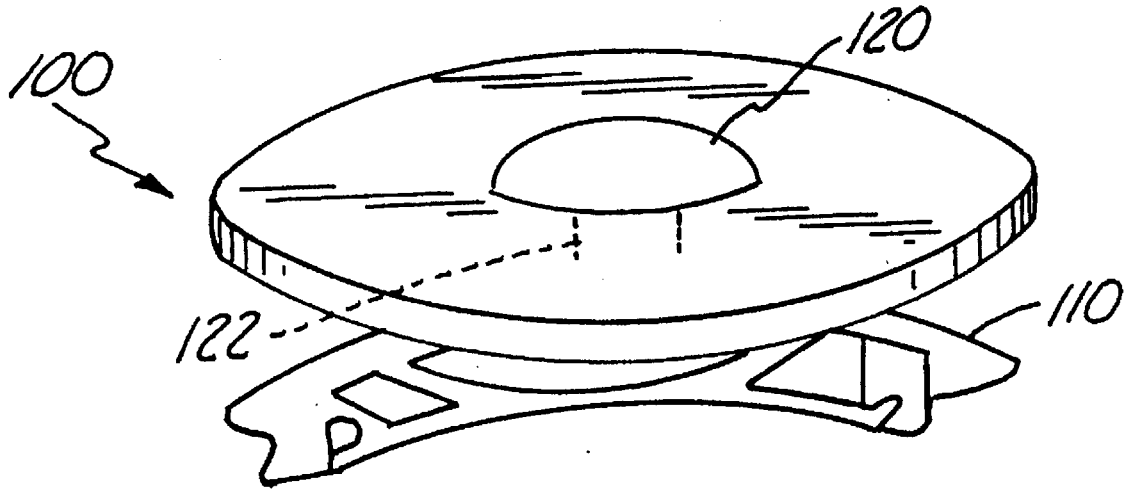
FIG. 2 illustrates the embodiment of FIG. 1 in unexploded view.

FIG. 1 illustrates one embodiment 100 for the present inventive barrette including a hair clamp 110 and a stem assembly 112 coupled to the hair clamp 110. In embodiment 100, stem assembly 112 includes a plurality of slots 113. Hair clamp 110 and stem assembly 112 may be made from metallic material which may then be coupled together by welding, for example.

Those skilled in the art will recognize that the portion of hair clamp 110 to which stem assembly 112 is coupled could also be made from other materials such as plastic. Stem assembly 112 could also be made of plastic for example, and could then be secured to hair clamp 110 by alternate means such as cementing or gluing. The preferred embodiment combines stem assembly 112 with hair clamp 110 into one piece made by a plastic injection molding process. Stem assembly 112 and hair clamp 110 could also be joined, for example, by some sort of a combination of a friction fit snap-on connecting means as is known to those skilled in the art. Less preferable connecting means may include, for example, a slide-on or magnetic devices. Also in the preferred embodiment, stem assembly 112 further includes one or more slots 113, a first end 114, a second end 115, a first outer surface 116 and, first inner surface 117, and one or more recesses 118 placed within the first inner surface 117.

FIG. 1 also illustrates one embodiment of an ornamental button assembly 120 having an ornamental head 124 and a shaft 122 for engaging stem 112. Ornamental button assembly 120 may vary in size, shape, color and material. In the preferred embodiment, ornamental head 124 will have a diameter substantially larger than the diameter of the shaft 122. In the preferred approach, one or more ribs 123 which form the connecting means 126 are coupled to the second outer surface 127 of the shaft 122. Shaft 122 may include a second inner surface 128 for ease of manufacture. Ribs 123 are sized such that the connecting means 126 is slightly larger than the first inner surface 117 of the stem assembly 112, yet capable of being securely received within any of several recesses 118 of the first inner surface 117 of the stem assembly 112. This approach gives a single barrette the flexibility to receive any combination of one, two, or more ornamental pieces, whereas the stem assembly 112 and ornamental button assembly 120 are just as securely coupled with three ornamental pieces installed as they are with one ornamental piece. Although the ornamental button assembly 120 illustrated in FIG. 1 depicts a ribbed shaft 122 for coupling the ornamental button assembly 120 to the stem assembly 112, the present invention is not so limited. For example, shaft 122 could easily be replaced with a friction fit snap-on fitting well known to those in the art of snap fittings, which could then be coupled to the stem assembly 112 by snapping the button 120 and the stem assembly 112 together.

When the stem assembly 112 and ornamental button assembly 120 of FIG. 1 are in the process of being coupled, one or more slots 113 of the stem assembly 112 allow the second end 115 of the stem assembly 112 to expand slightly. Once the stem assembly 112 and ornamental button assembly 120 are properly coupled, the connecting means 126 of the shaft 122 is securely received within one or more of the recesses 118 of the first inner surface 117 of the stem assembly 112, and the second end 115 of the stem assembly 112 automatically retracts to its normal, unexpanded form.

It can he seen from FIG. 1 that an ornamental barrette 100 can be formed with ornamental button assembly 120 affixed to a stem assembly 112 and hair clamp 110 without the addition of one or more ornamental appendages such as bows, ribbons and the like.

Figure 3:
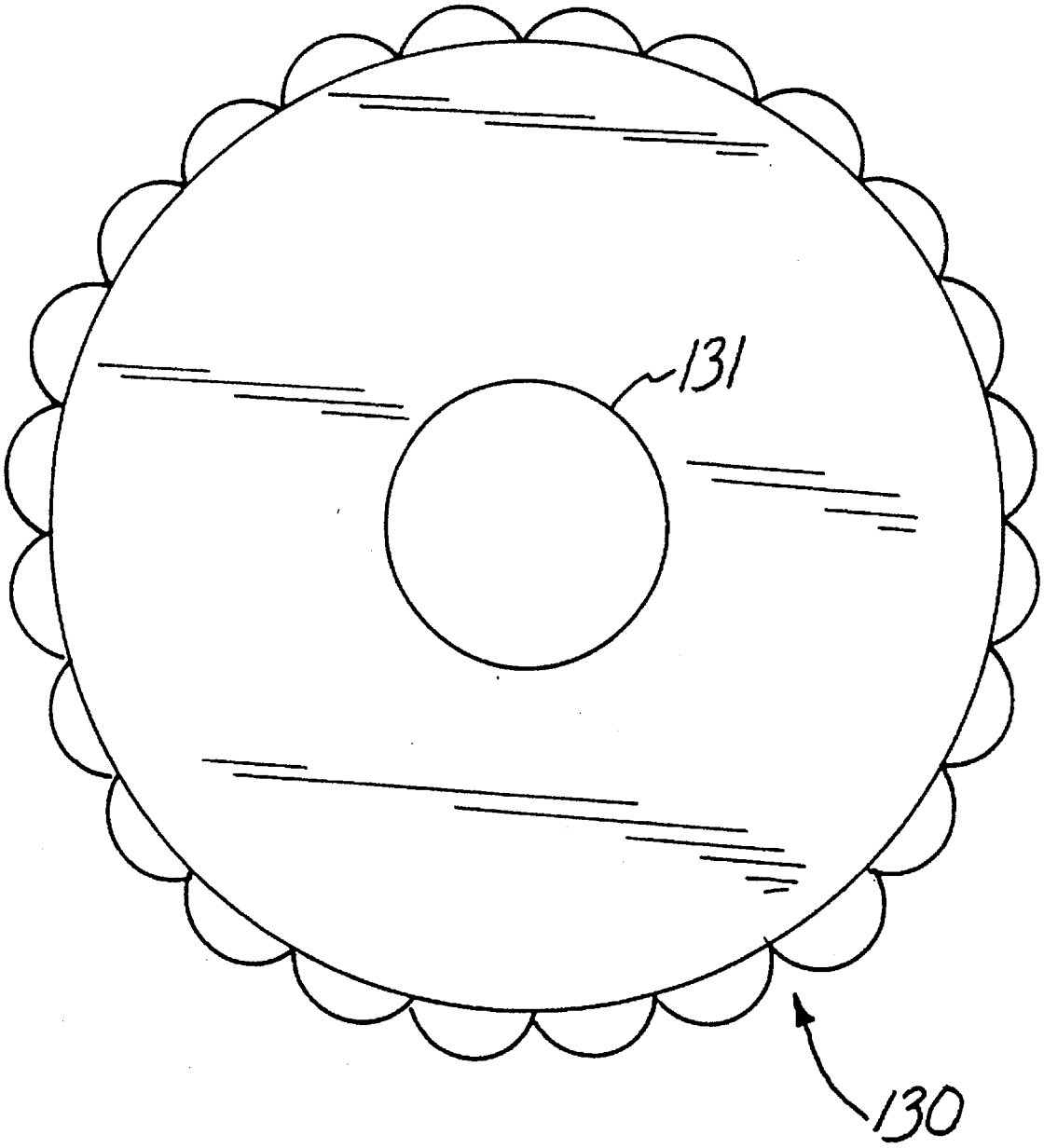
FIG. 3 illustrates a top view of the ornamental piece in the embodiment of FIG. 1.

FIG. 3 illustrates a top view of a representative ornamental piece 130. Ornamental pieces can be made from many different materials, including fabrics such as cotton, linen, and silk, and further including plastics and metals. Also, ornamental pieces can be made into a variety of sizes and shapes at the pleasure of the designers and the barrette-wearing consumers. In the preferred embodiment, the ornamental piece 130 has an opening 131 which is ideally but not necessarily placed at the center of the ornamental piece 130. The opening 131 is of sufficient size to be received by the stem assembly 112 of the hair clamp 110, but smaller than the diameter of the ornamental head 124 of the ornamental button assembly 120.

Figure 4:
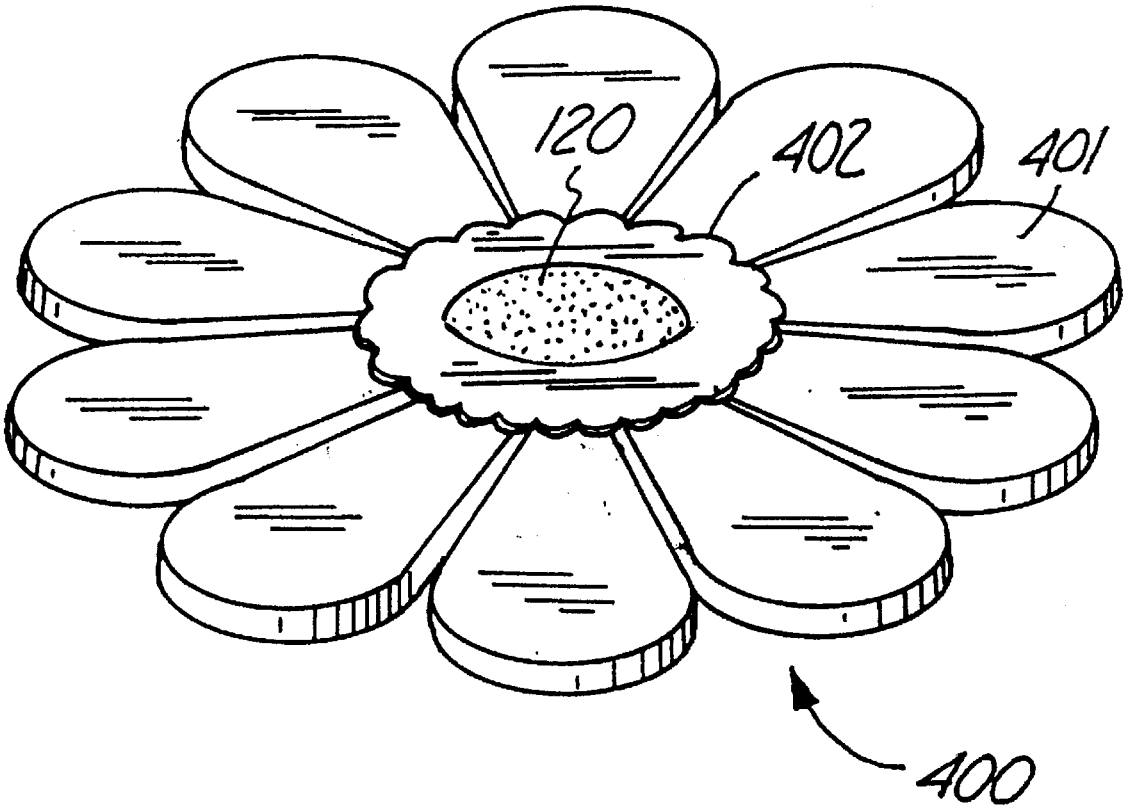
FIG. 4 illustrates an ornamental bow coupled with a rapid disconnect ornamental securing mechanism as shown in FIG. 1.

FIG. 4 is a slightly elevated side view illustration of another embodiment 400 of the inventive barrette. Here, two ornamental pieces 401,402 are received within the stem assembly 112 of the hair clamp 100, and secured by the proper coupling of the ornamental button assembly 120 to the stem assembly 112.

Figure 5:
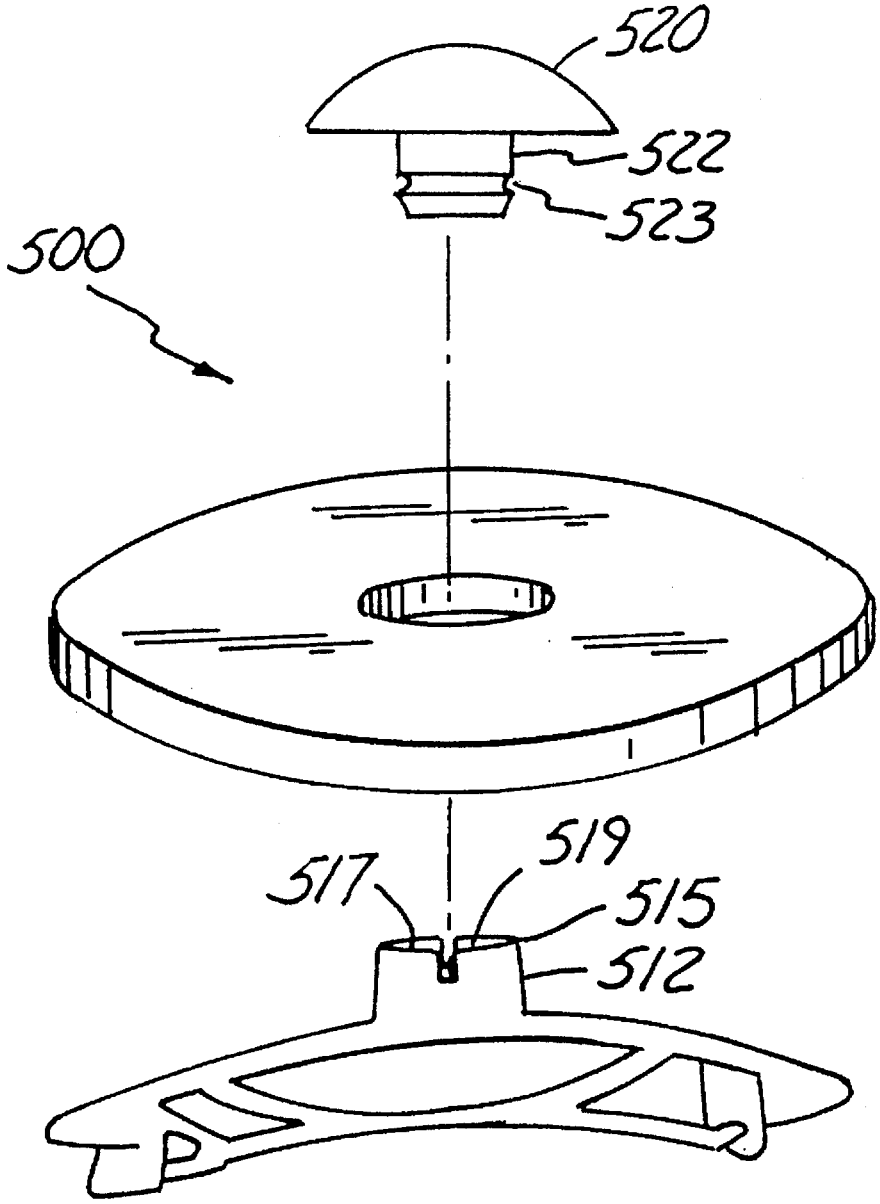
FIG. 5 shown an alternate embodiment illustrating a plurality of ornamental appendages securely attached to a hair clamp with an ornamental rapid disconnect securing mechanism such as that shown in FIG. 1.

FIG. 5 illustrates another embodiment 500 of the inventive barrette which includes a variation of the connecting means and stem assembly heretofore described, wherein one or more ribs 519 are placed within the first inner surface 517 of the second end 515 of the stem assembly 512, and wherein the shaft 522 of the ornamental button assembly 520 has one or more corresponding recesses 523. All remaining elements are identical to those described in FIG. 1. With exception of the placement of the ribs 519 and recesses 523, the barrette of FIG. 5 is the functional equivalent of the barrette of FIG. 1.

The embodiments shown in FIGS. 1 through 5 are intended to be illustrative and the present invention is not so limited. For example, any number of ornamental appendages including ribbons, bows and the like may be received by the stem assembly 112 secured in place with ornamental button assembly 120. In this way, a broad variety of color coordinates quickly become available, both casual and formal, and at an economical price.

This invention has been described herein in considerable detail in order to comply with the Patent Statutes and to provide those skilled in the art with the information needed to apply the novel principles and to construct and use such specialized components as are required. However, while a particular embodiment of the present invention has been described herein in detail, it is to be understood that various alterations, modifications and substitutions can be made therein without departing from the spirit and scope of the present invention, as defined in the following

I claim:

1. A hair barrette for securing ornamental appendages to a tress of hair, comprising:

(a) a hair clamp for clamping said tress of hair;

(b) a stem assembly coupled to said hair clamp, said stem assembly comprising a first end, a second end, said second end further comprising at least one slot extending substantially lengthwise along said stem assembly, a first outer surface and a first inner surface, said inner surface further comprising at least one recess;

(c) an ornamental button assembly comprising an ornamental head and a shaft, said ornamental head having a diameter substantially larger than the diameter of said shaft, said shaft comprising a second outer surface; and (d) a connecting means for coupling said stem assembly to said ornamental button assembly, said connecting means having at least one rib coupled to said second outer surface, said at least one rib capable of being removably contained within said at least one recess, said connecting means allowing for rapid replacement, removal and addition of a plurality of said ornamental appendages.

2. The hair barrette of claim 1, further comprising at least one ornamental piece, said ornamental piece having an opening smaller than said ornamental head and slightly larger than said stem assembly, said ornamental piece being removably received by said stem assembly through said opening, whereby said ornamental piece is secured between said hair clamp and said ornamental button assembly when said hair clamp and said ornamental button assembly are coupled.

3. A hair barrette for securing ornamental appendages to a tress of hair, comprising:

(a) a hair clamp for clamping said tress of hair;

(b) a stem assembly coupled to said hair clamp, said stem assembly comprising a first end, a second end, a first outer surface, a first inner surface, and a connecting means, said second end having at least one slot extending substantially lengthwise along the stem assembly; and (c) an ornamental button assembly comprising an ornamental head and a shaft, said ornamental head having a diameter substantially larger than the diameter of said shaft, said shaft comprising a second outer surface, said second outer surface having at least one recess, said connecting means comprising at least one rib coupled to said first inner surface of said stem assembly, said connecting means capable of being removably contained within at least one recess of said second outer surface, said connecting means allowing for rapid replacement, removal and addition of a plurality of said ornamental appendages.

4. The hair barrette of claim 3, further comprising at least one ornamental piece, said ornamental piece having an opening smaller than said ornamental head and slightly larger than said stem assembly, said ornamental piece being removably received by said stem assembly through said opening, whereby said ornamental piece is secured between said hair clamp and said ornamental button assembly when said hair clamp and said ornamental button assembly are coupled.

* * * * *